US005363934A

United States Patent [19]

Edmund et al.

[11] Patent Number: 5,363,934

[45] Date of Patent: Nov. 15, 1994

[54] WHEELCHAIR

[75] Inventors: Nicholas E. Edmund, 4, Dartmouth Terrace, London SE10 8AX; Steven H. M. Kyffin, London, both of United Kingdom

[73] Assignee: Nicholas E. Edmund, United Kingdom

[21] Appl. No.: 50,088

[22] PCT Filed: Oct. 18, 1991

[86] PCT No.: PCT/GB91/01827

§ 371 Date: Apr. 29, 1993

§ 102(e) Date: Apr. 29, 1993

[87] PCT Pub. No.: WO92/07539

PCT Pub. Date: May 14, 1992

[30] Foreign Application Priority Data

Nov. 1, 1990 [GB] United Kingdom ..... 9023750

[51] Int. Cl.[5] ..... A61G 5/04; A61G 5/14

[52] U.S. Cl. ..... 180/6.5; 180/65.1; 180/907; 280/250.1; 280/304.1; 280/DIG. 5; 297/DIG. 10

[58] Field of Search ..... 180/6.5, 65.2, 65.5, 180/907, 65.1; 280/250.1, 304.1, DIG. 5; 297/DIG. 10

[56] References Cited

U.S. PATENT DOCUMENTS

| | | | |
|---|---|---|---|
| 3,807,795 | 4/1974 | Weant et al. | 297/DIG. 10 |
| 3,882,949 | 5/1975 | Anderson | 180/8 |
| 4,119,164 | 10/1978 | Fogg, Jr. et al. | 180/6.5 |
| 4,249,744 | 2/1981 | Andreasson | 297/311 |
| 4,613,151 | 9/1986 | Kielczewski | 280/650 |
| 5,042,607 | 8/1991 | Falkenson et al. | 280/DIG. 5 |

FOREIGN PATENT DOCUMENTS

| | | |
|---|---|---|
| 1424462 | 2/1976 | United Kingdom . |
| 2017014 | 9/1979 | United Kingdom . |
| 2124560 | 2/1984 | United Kingdom . |
| 2224980 | 5/1990 | United Kingdom . |

*Primary Examiner*—Mitchell J. Hill
*Attorney, Agent, or Firm*—Perman & Green

[57] ABSTRACT

A wheelchair is provided which due to its weight distribution and general design is particularly suited for enabling disabled people to play golf to a sufficient standard to enable them to play on a proper golf course and alongside able-bodied players. The wheelchair does not damage the golf course because it distributes its weight onto a wide surface area of the ground by virtue of wide wheels. A seat can be automatically raised so as to enable the wheelchair user to be lifted from a sitting position to a standing position at which the wheelchair user can play a proper golfing stroke using conventional golf clubs. The front wheel units have a wider track than the rear wheel units in order to provide lateral stability when the golfing stroke is being played. Relatively heavy components such as the lightweight battery unit and the seat adjustment mechanism are positioned low down in the wheelchair in order to provide a low center of gravity. The wheelchair is driven and the seat raised and lowered by means of control buttons on an arm rest. The arm rest is positioned such that, when the seat is in its raised position, the arm rest does not obstruct the golfing swing.

26 Claims, 7 Drawing Sheets

WHEELCHAIR

BACKGROUND INVENTION

1. Field of the Invention

This invention relates to a wheelchair and in particular to a wheelchair from which golf may be played.

2. Description of the Prior Art

Disabled golf players have, up until now, used so-called "micro-cars". A typical micro-car is "scooter-like" in appearance and has three wheels of small diameter (e.g. 20 cm). The micro-car has a platform on which are mounted a motor and batteries. A rotatable seat projects up from the back of the platform and handlebars project up from the front of the platform to control the steering angle of the single front wheel. The disabled person drives to the playing location on the golf course and then stops the vehicle by the side of the golf ball on the ground. The seat is then rotated so that the player faces the side of the ball. The stroke is then played, whilst still sitting on the seat, by using a specially lengthened golf club which is needed because of the unorthodox stance resulting from playing from such a sitting position. Having to use a special golf club is a psychological hindrance and, because of the extra weight, may be physically difficult. Most disabled players would like to use normal golf clubs. Also, it is hard to play a proper golfing stroke whilst sitting on the seat.

The weight and design of the micro-car means that traditional golf clubs are worried that the micro-cars will damage their golf courses and particularly their greens. Moreover, the design of the micro-car leads golf clubs to believe that disabled players would play to a low standard and would have difficulty in coping with normal golfing hazards such as bunkers. Thus, traditional golf clubs will not allow them on their courses and this further restricts the ability of disabled golfers to play golf properly.

SUMMARY OF THE INVENTION

According to the present invention, there is provided a wheelchair comprising a pair of rear wheel units each having a width of at least 8 cm, a pair of front wheel units each having a width of at least 8 cm, first prime mover means for driving at least one of the wheel units, a seat movable between a first position and a second position above the first position and second prime mover means for driving the seat between its two positions.

The wheelchair is particularly suited for enabling a disabled person to play golf, but it may also be used to enable a disabled person to play other sports. The wheelchair of the present invention combines the benefits of (i) wide ("low-pressure") wheel units which do not damage the fairways, greens and bunkers of traditional golf courses and (ii) being able to raise the user from a sitting position to a position approximating that which an able-bodied golfer would adopt when playing a stroke (i.e. a substantially standing position of address over the ball).

The minimum width of each wheel unit may be at least 10 cm, 12 cm, 15 cm or 20 cm. As the width increases, the pressure exerted by the wheel units on the surface (e.g. turf) of the golf course decreases, thereby reducing the likelihood of the turf being damaged.

Preferably, the diameter of each wheel unit is less than 450 mm. Preferably, the diameter of each rear wheel unit is less than 400 mm and the diameter of each front wheel unit is less than 300mm. Having small diameter wheel units helps minimise the weight of the wheelchair. Also, if the upper surface of the seat, when it is in its first position, is above the tops of the wheel units, then the wheel units do not get in the way of the wheelchair user.

Preferably, the seat, at least when in its second position, is located closer to the front wheel units than the rear wheel units and the track of the front wheel units is wider than the track of the rear wheel units. The term "track" has its usual meaning of the separation between the outer edges of the wheel units in question. With the seat in its second (i.e. raised) position, the user is able to play a proper golfing stroke. The wider track of the front wheel units (i.e. the wheel units closer to the seat in the second position) helps to provide lateral stability that prevents the reaction forces generated during the golfing stroke from toppling the wheelchair over onto its side.

Preferably, the wheelchair further comprises at least one arm rest each located at a respective side of the seat, the seat having an upper seat surface arranged to be below the top(s) of the arm rest(s) when the seat is in its first position and level with or above the top(s) of the arm rest(s) when the seat is in its second position. Thus, when the user has the seat in the first position and is travelling from place to place in the wheelchair, the user has available the arm rest(s). However, when the user stops the wheelchair and raises the seat to its second position in order to play a golfing stroke, the top(s) of the arm rest(s) are level with or below the seat surface and therefore the arm rest(s) do not impede the golfing stroke.

Preferably, one of the at least one arm rest includes control means for controlling the first and second prime mover means. This arrangement makes control (e.g. steering, stopping and starting the wheelchair and raising and lowering the seat) particularly easy because the arm of the user may rest on the arm rest when the seat is in its first (lower) position.

Preferably, the control means are located in the forward end of said one arm rest. Thus, the controls are by the hand of the user when the user's arm is resting on the arm rest.

Preferably, the wheelchair further comprises storage and display means mounted on one of the at least one arm rest. This enables the user to keep a tally of his or her own score and the scores of the people the wheelchair user is playing against.

Preferably, the wheelchair further comprises a back support which with the seat, when the seat is in its first position, forms a chair, the back support being separate from the seat, whereby the seat moves up the back support as the seat moves from its first to its second position. When the seat is in its second position, the wheelchair user will be about to play a golfing stroke and therefore does not need to have his or her back supported by the back support. For this reason, the back support is separate from the seat and does not need to move up and down with the seat. The back support may therefore be mounted on a chassis of the wheelchair. Because the back support does not need to move up and down, the construction of the wheelchair is simplified.

Preferably, the wheelchair further comprises a chassis having a generally planar first frame on which are mounted the front and rear wheel units, the first and second prime mover means being mounted in respective apertures of the first frame, with the first prime mover means being located between the rear wheel units and arranged to provide drive thereto and the second prime mover means being located between the front and rear wheel units and underneath the seat.

The prime mover means are usually amongst the heaviest components of the wheelchair. By having the two prime mover means located in apertures in the first frame, a low centre of gravity may be achieved in order to give the wheelchair stability. Also, by having the first prime mover means located between the rear wheel units and the second prime mover means located between the front and rear wheel units, the centre of gravity may be arranged to be just in front of the center line running between the rear wheel units. Then, when a user of average weight sits on the seat of the wheelchair, and any objects such as golf clubs are loaded onto the wheelchair, the center of gravity of the loaded wheelchair may be arranged to be approximately halfway between the front and rear wheel units, in order to provide maximum stability.

Preferably, the first frame has a forward cross-member and a pair of struts which project forwards from and outwards away from respective ends of the forward cross-member and which carry respective ones of the front wheel units. This arrangement helps to maintain the stability of the wheelchair whilst keeping the first frame (i.e. the forward cross-member) from obstructing movement of the user's feet.

Preferably, the chassis further comprises a second frame mounted on the first frame and which supports the back support and the at least one arm rest. Preferably, the second frame projects down in front of the front wheel units and there supports at least one foot rest.

Preferably, a platform is provided behind the back support and on top of the first prime mover means. Preferably, the platform comprises the upper surface of the first prime mover means. The platform may be used to carry a bag of golf clubs.

Preferably, the wheelchair further comprises a pivot means for pivoting an object from a position above the platform to a position closer to the front of the wheelchair. Preferably, the position closer to the front of the wheelchair is a position adjacent to the side of the seat. In this way, if the object is a bag of golf clubs, the user is able to gain easy access when needed to the clubs. The pivot means may be mounted on a vertically elongate storage unit located behind the back support and fixed to the first and second chassis frames. Third prime mover means may be provided for driving the pivot means to move the object between the two pivotal positions.

Preferably, the first prime mover means comprises first and second electric motors each drivingly connected to a respective one of the rear wheel units, the second prime mover means comprises a third electric motor, a gear train and a vertically movable seat support member and the first and second prime mover means further comprise a common battery means. Preferably, the first and second prime mover means further comprise a common recharger means connectable to a supply of electricity to recharge the battery means.

Preferably, the seat comprises (i) a rear part which remains substantially horizontal as the seat moves between its first and second positions and (ii) a front part which pivots from a substantially horizontal position to a forwardly downwardly inclined position as the seat moves from its first to its second position. With this arrangement, the front part of the seat supports the user's thighs when the seat is in its first position. As the seat rises up to its second position, the user's buttocks remain supported on the rear part of the seat whilst the front part of the seat pivots downwards relative to the rear part and permits the user's legs to adopt a substantially standing position. Thus, unlike a one-piece seat, where the user would have to shuffle his buttocks towards the front edge of the seat, the user does not have to move on the seat. The seat does all of the work to bring the user to a standing, golf-playing position. Preferably, the front seat part is arranged to permit adjustment of its forwardly downwardly inclined position. This enables the front seat part to be adjusted to slope at the same angle as the user's thighs when the user has found the most comfortable playing position.

Preferably, the height of the second seat position above the first seat position is adjustable. This enables the user to select the most appropriate height for a comfortable playing position for a club of a particular length.

Preferably, the seat is pivotable about a substantially vertical axis. This enables the user's upper body to swing round as the stroke is played.

BRIEF DESCRIPTION OF THE DRAWINGS

The invention will now be described by way of non-limiting example with reference to the accompanying drawings, in which:-

DETAILED DESCRIPTION OF THE PREFERRED EMBODIMENTS

Figure 1:
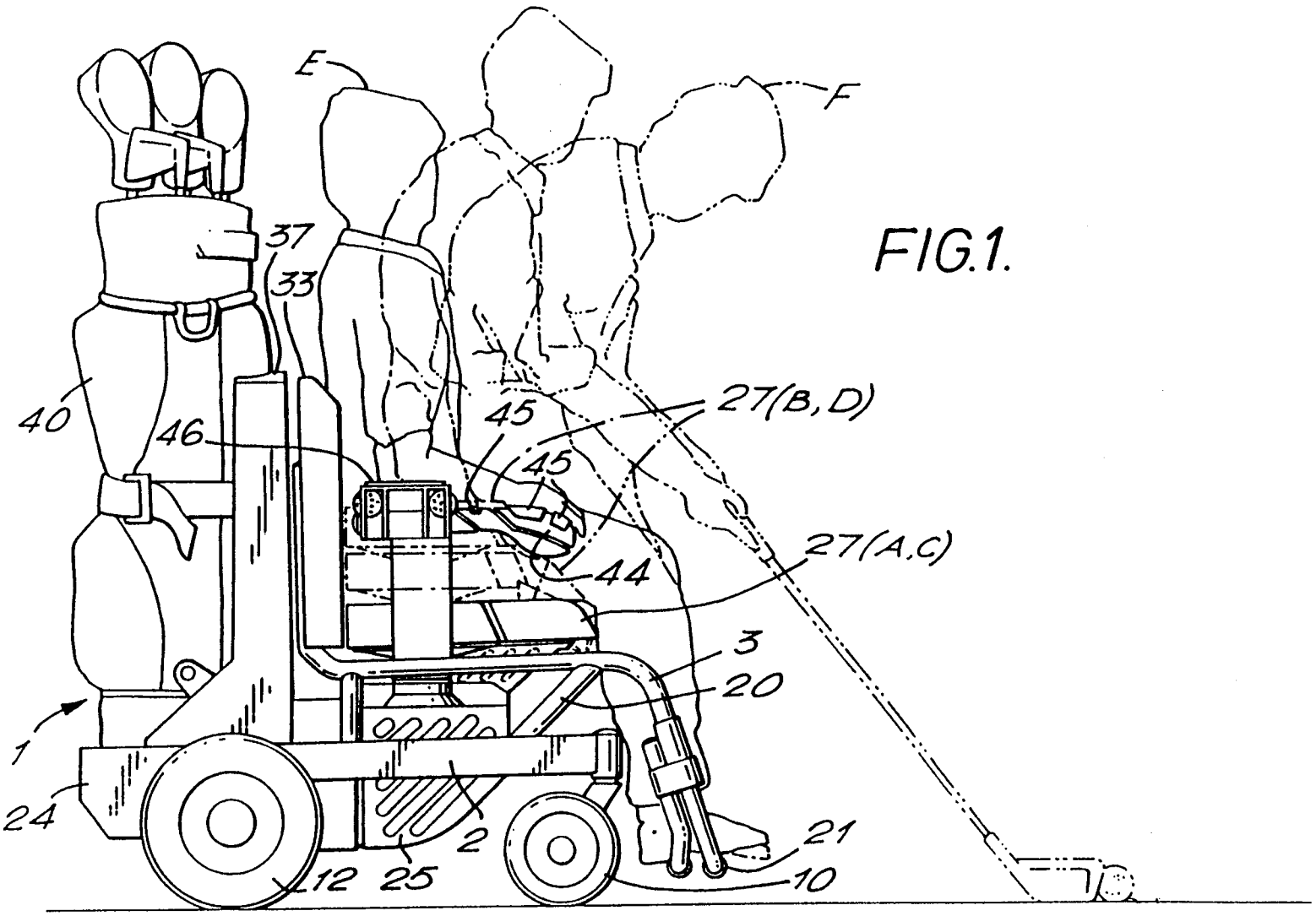
FIG. 1 is a side view of a wheelchair in accordance with the present invention.
Figure 2:
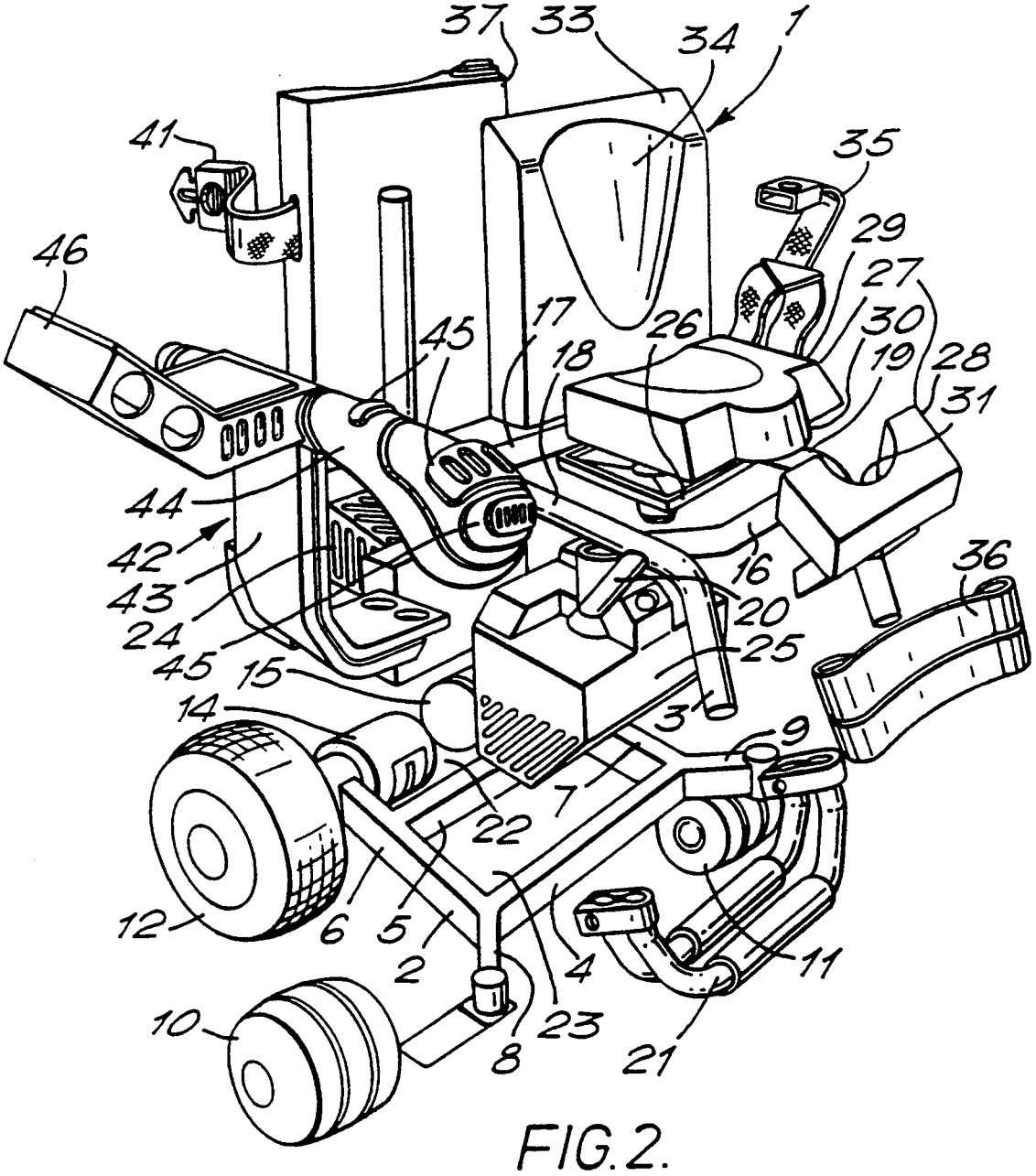
FIG. 2 is an exploded perspective view of the wheelchair.

Referring to FIGS. 1 to 7, the wheelchair 1 has a chassis comprising a first generally planar and rectangular frame 2 and a tubular second frame 3 mounted on the first frame 2.

The first frame 2 comprises a forward cross-member 4, a rear cross-member 5, side members 6, 7 and strut members 8, 9 which project forwards and sideways away from respective ends of the forward cross-member 4.

Each strut member 8, 9 carries a respective castor wheel unit 10, 11. Each castor wheel unit 10, 11 has a diameter of approximately 20 cm and a width of approximately 15 cm.

From the rear of each side member, there projects rearwardly and downwardly a trailing arm (not visible in the drawings) on which is mounted a respective wheel unit 12, 13 having a synthetic or natural rubber tire which provides good traction on a grass surface and over sand. Each wheel unit 12, 13 has a diameter of approximately 30 cm and a width of approximately 10 cm. Each wheel unit 12, 13 is driven by a respective electric motor 14, 15 mounted on the associated trailing arm, inwardly of the wheel unit.

Figure 5:
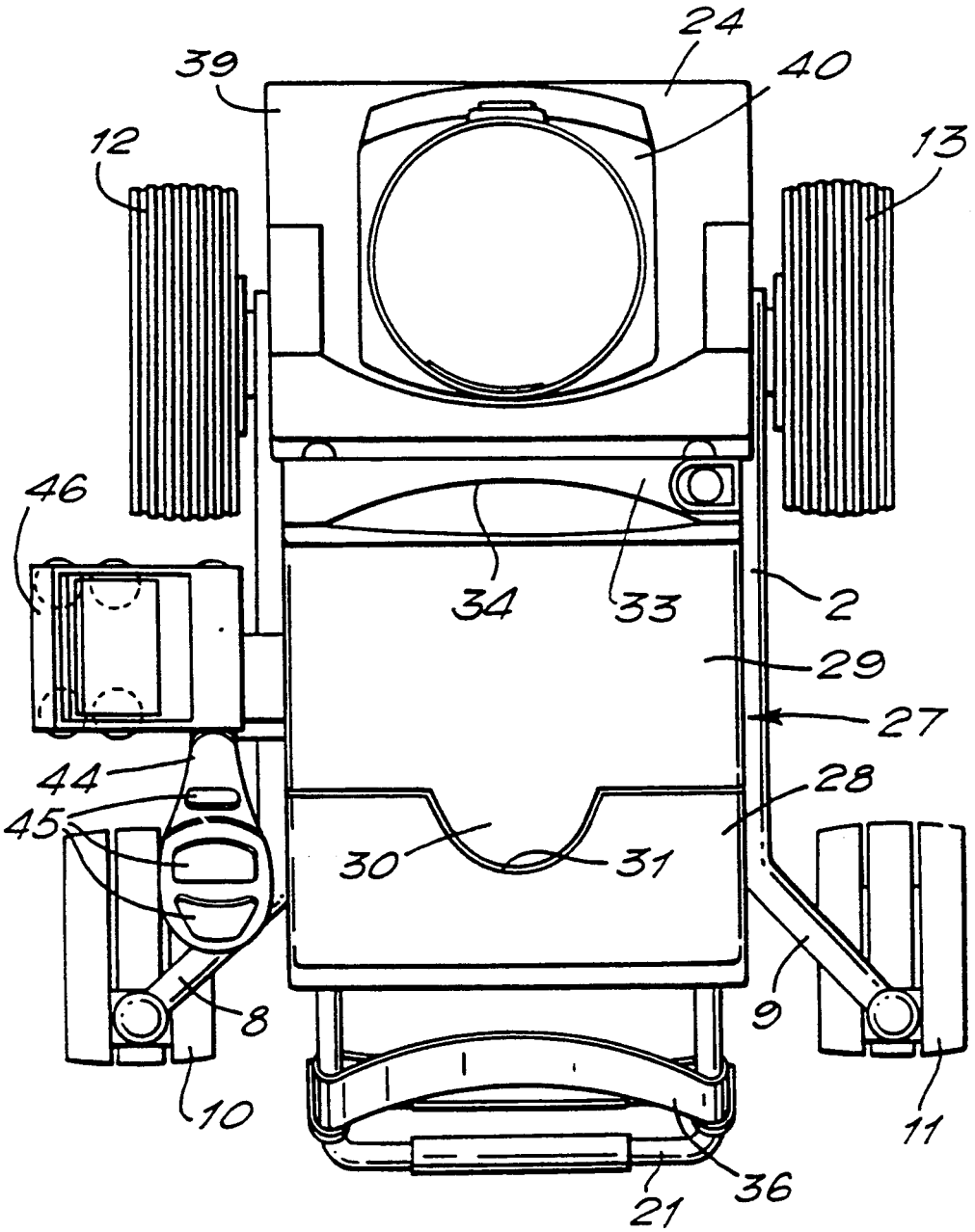
Figure 6:
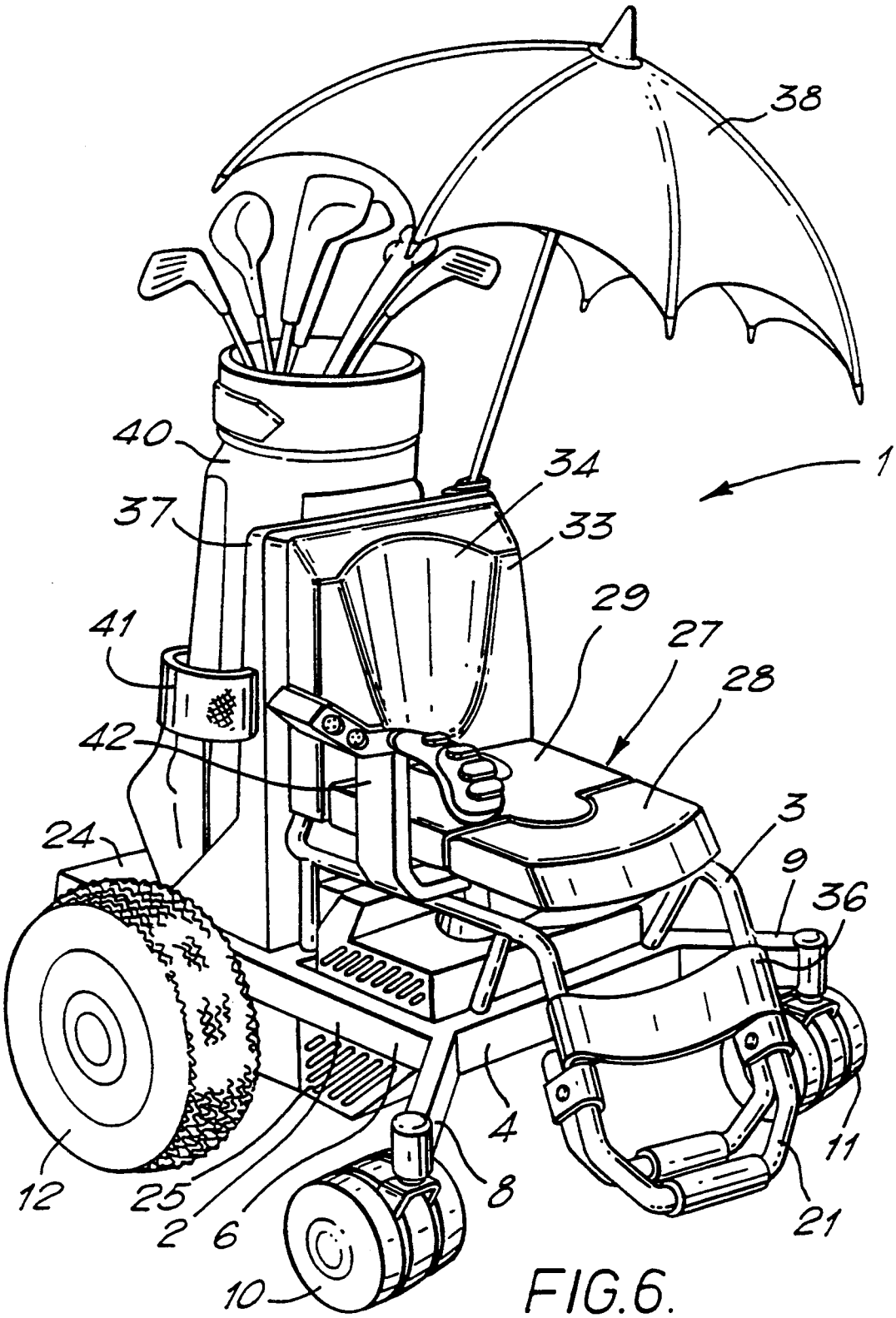
FIG. 6 is a perspective view of the wheelchair with a seat thereof in a lower position.

As may be seen, in particular from FIG. 5, the track, as measured from outer edge to outer edge, of the castor wheel units 10, 11, is greater than the track of the wheel units 12, 13.

The second frame 3 comprises a forward cross-member 16, a rear cross-member 17 and side members 18, 19. Each side member 18, 19 has a generally L-shaped configuration. The second frame 3 has four generally vertical struts 20 which space the second frame 3 above the first frame 2.

A foot rest 21 is detachably mounted on the front free ends of the side members 18, 19 of the second frame 3.

The first frame 2 has an aperture 22 located behind the rear cross-member 5 and between the side members 6, 7 and an aperture 23 defined between the front and rear cross-member 16, 17 and the side members 18, 19.

Attached to the first frame 2 and located in the aperture 22 is a combined battery and battery recharging unit 24. Located in the aperture 23 is a seat adjustment mechanism 25.

The battery and battery recharging unit 24 is arranged to provide electrical power to the electric motors 14, 15 and an electric motor (not shown) located within the seat adjustment mechanism 25. The electric motor within the seat adjustment mechanism 25 is arranged to drive, via a gear mechanism (not shown), a column (not shown) which projects out of the top of a cover of the seat adjustment mechanism. On this column is mounted a platform 26.

The wheelchair 1 has a seat 27 split into a front seat part 28 and a rear seat part 29. The rear seat part 29 is mounted on the platform 26 and is movable by the seat adjustment mechanism 25 from a first position A at which the wheelchair user is seated to a second position B above the first position A and at which the wheelchair user adopts a substantially standing position.

The rear seat part 29 has a projection 30 which is received within a recess 31 of the front seat part 28 when the front seat part 28 is in its lower position.

The front bottom edge of the front seat part 28 is pivotably mounted on a projecting boss 32 of the seat adjustment mechanism 25. The seat adjustment mechanism 25 is arranged, by a mechanism not shown, to tilt the front seat part 28 forwards at the same time as it raises up the rear seat part 29. Thus, when the rear seat part 29 is in its position A, the front seat part 28 is in a first position C. When the rear seat part 29 is in its raised position B, the front seat part 28 is in a tilted forwards and downwards position D.

When the front and rear seat parts 28, 29 are in their positions A, C, the user of the wheelchair is supported in a sitting position E. The user's thighs are substantially horizontal and supported by both the front and rear seat parts 28, 29.

When the seat adjustment mechanism 25 is activated to raise the front and rear seat parts 28, 29 to their positions B, D, the user of the wheelchair adopts a substantially standing position F (see FIG. 1).

In position F, the wheelchair user is able to play a golfing stroke using a normal golf club.

In the standing position F, the user's weight is supported via his or her buttocks on the rear seat part 29. The front seat part 28 in its position D slopes downwards at substantially the same angle as the user's thighs and carries little or none of the weight of the user. Position D may be manually adjusted so that it can be varied to suit a desired angle of the user's thighs. A back support 33 is fixed to the upward arms of the L-shaped side members 18, 19 of the second frame 3. The back support 33 has a depression 34 in order to provide lateral stability to the torso of the wheelchair user. As the rear seat part 29 is raised from position A to position B, it slides up the front surface of the back support 33. The back support 33 is not raised with the rear seat part because, as is apparent from the illustration of the standing position F of the user in FIG. 1, there is no need to support the back of the user when the user has been raised up to the standing position to play a golfing stroke.

A restraint harness 35 is attached to the platform 26 and enables the user to secure him or herself to the seat 27 when in the sitting position E and the standing position F. Thus, the wheelchair user is prevented from falling out of the wheelchair whilst the wheelchair is moving or the golf stroke is being played.

Whilst the wheelchair is shown with the foot rest 21 and FIG. 1 shows the user resting his or her feet on the foot rest, both when in the sitting position E and when in the standing position F, some users may wish to dispense with the foot rest and choose to position their feet on the ground when they have been raised to the standing position F.

For those wheelchair users who do not have any movement in their legs, an optional leg restraint 36 is provided on the second frame 3 immediately above the foot rest 21. The wheelchair user passes his or her legs through the leg restraint 36 in order to restrain them in the known manner.

Provided behind the back support 33 is a vertically elongate container 37 which is secured at its base to the first frame 2 and at its front face to the upward arms of the L-shaped side members 18, 19 of the second frame 3. Objects such as an umbrella 38 may be stored and carried in the container 37.

The battery and battery recharging unit 24 has an upper surface 39 which acts as a platform on which a bag of golf clubs 40 may be carried. A strap 41 is provided at the top of the container 37 in order to extend from one side of the container, round the bag of golf clubs 40 and to the other side of the container 37. In this way, the bag of golf clubs 40 may be securely attached to the wheelchair.

Attached to the right-hand side of the second frame 3 is an arm rest 42. The arm rest 42 comprises an upwardly extending portion 43 and, on top thereof, a generally horizontally extending portion 44. The forward end of the portion 44 has a generally bulbous shape in order to snugly fit under the right-hand of the user. The front end of the horizontal portion 44 carries a plurality of control buttons 45 which control the function of the battery and battery recharger unit 24, the electric motors 14, 15 and the seat adjustment mechanism 25. By means of the control buttons 45, the electric motors 14, 15 may be supplied with current from the battery and battery recharging unit 24 in order to drive the wheelchair forwards and backwards. By means of the known technique of supplying different amounts of power to the electric motors 14, 15, the wheelchair may be made to turn to the left and to the right.

The control buttons 45 are used to control the supply of current from the battery and battery recharging unit 24 to the seat adjustment mechanism 25 so as to thereby control the raising and lowering of the seat 27 between its raised and lowered positions. The control buttons 45 are also used to control the recharging of the battery and battery recharger unit 24 when the wheelchair is returned to a base station and plugged into an external source of electricity.

Attached to the horizontal portion 44 of the arm rest 42 is a scoring unit 46 to which a golf score card may be attached. The unit 46 also has a portion that is able to store golf balls, thereby permitting easy access to golf balls by the user of the wheelchair.

Figure 3:
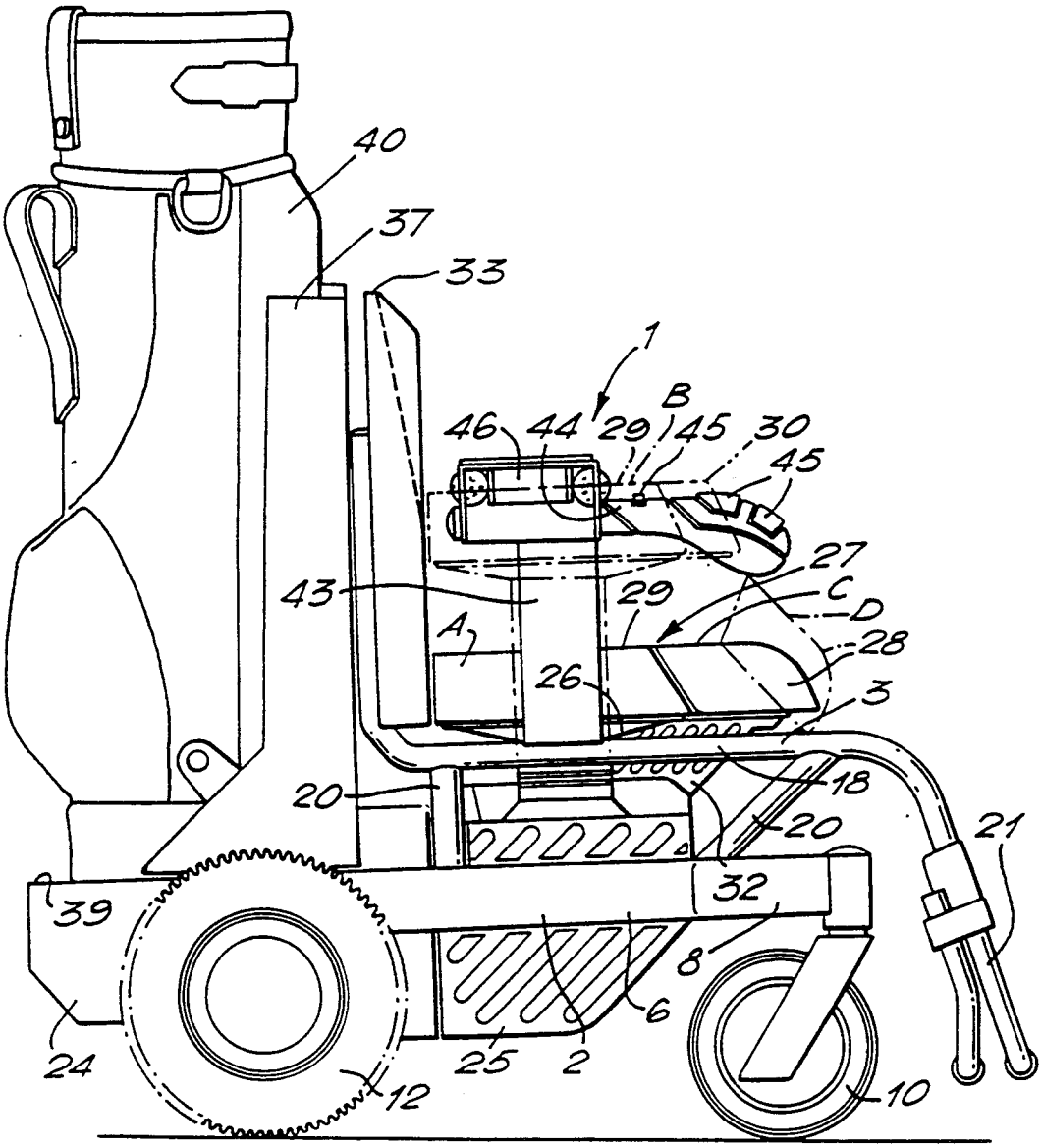
FIGS. 3, 4 and 5 are side, front and plan views respectively of the wheelchair.
Figure 4:
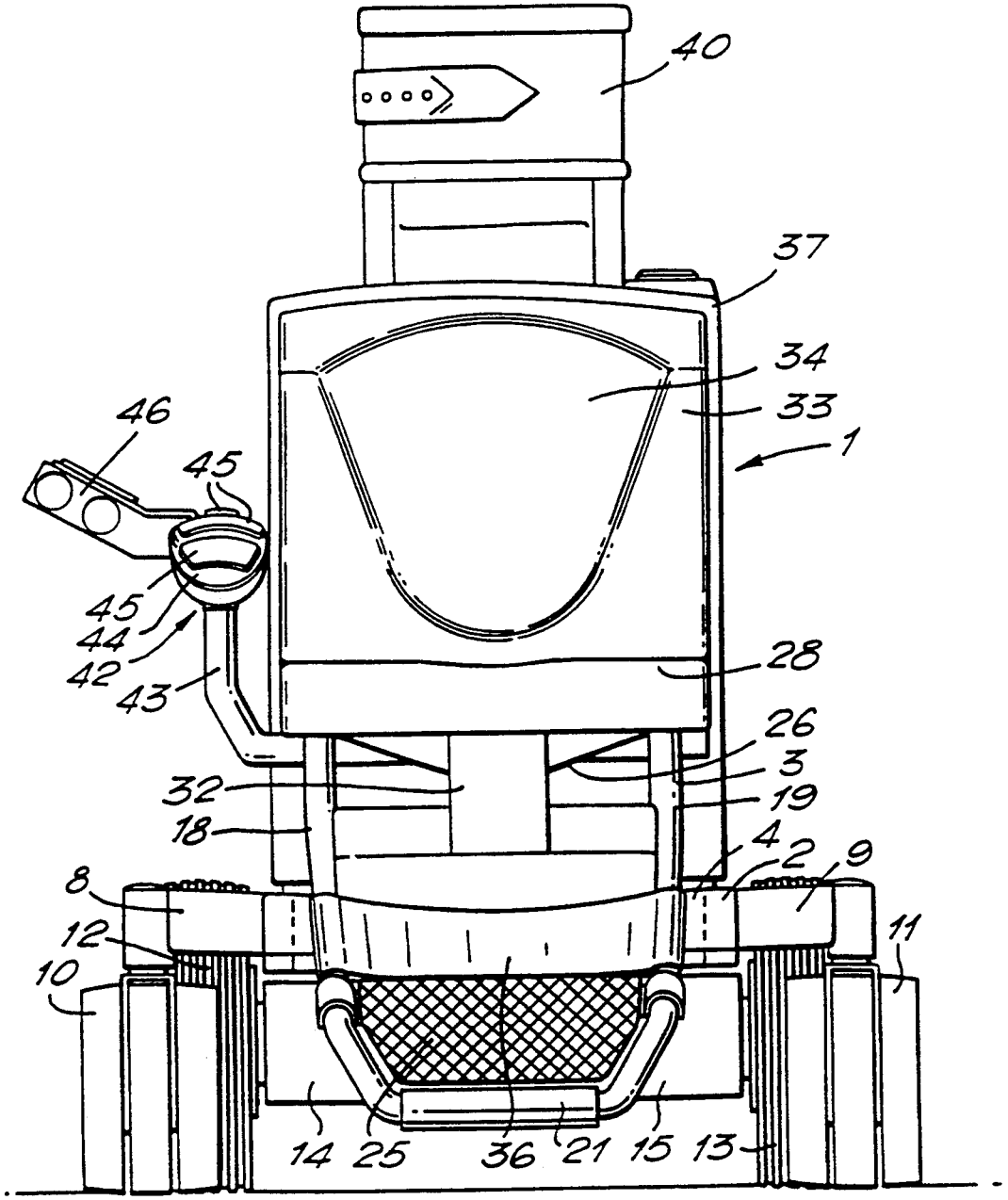
Figure 7:
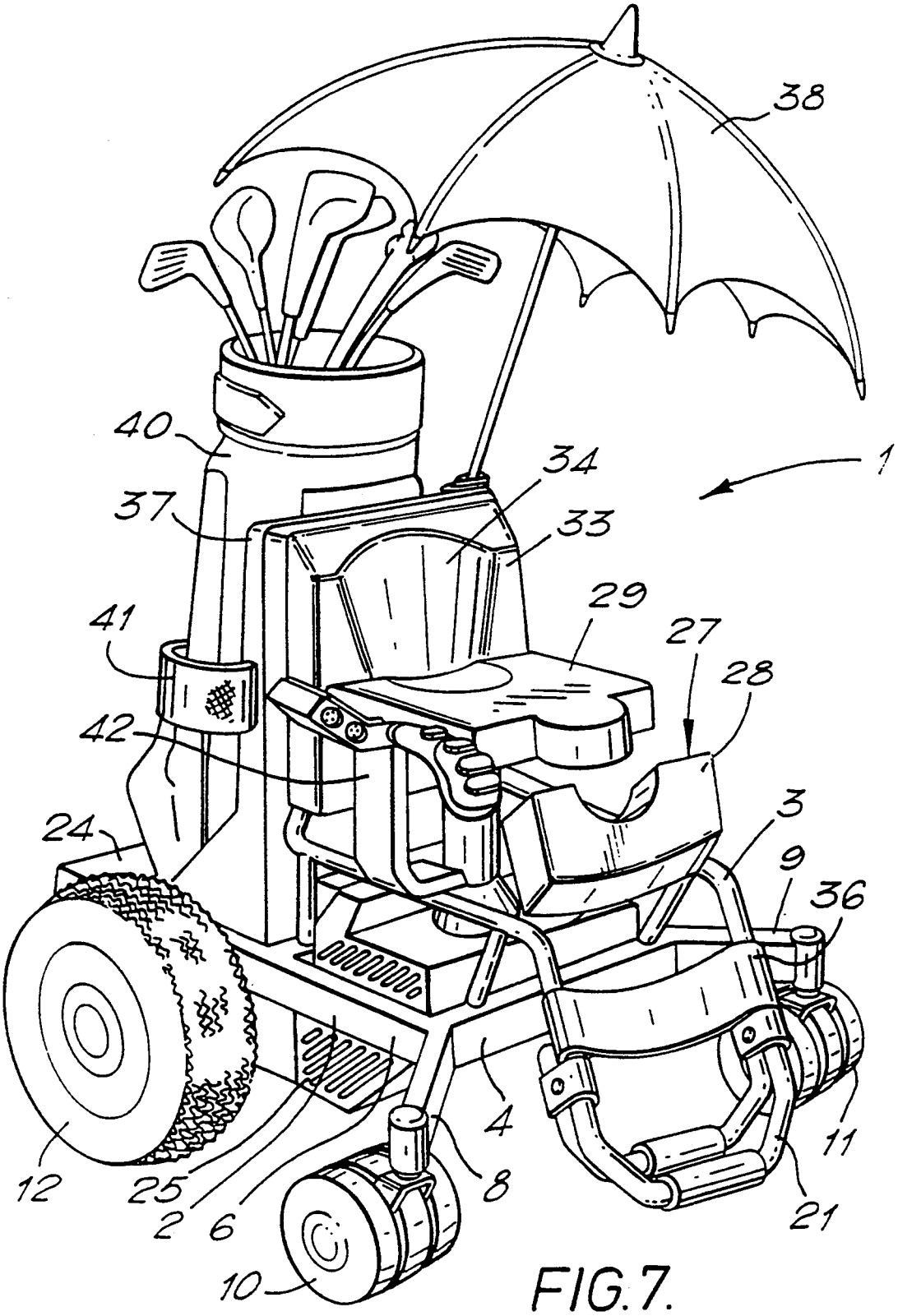
FIG. 7 is a view similar to that of FIG. 6 but showing the seat in an upper position.

As may be seen from FIGS. 1, 3 and 7, the top surface of the horizontal portion 44 of the arm rest 42 is, when the seat 27 is in its lowered position, at a height which enables the user in the sitting position E to rest his or her right lower arm on the horizontal portion 44 with the user's hand located over the control buttons 45. When the seat 27 is raised to its upper position, the top surface of the horizontal portion 44 of the arm rest 42 is located beneath the top surface of the rear seat part 29 of the seat 27. Thus, the arm rest 42 does not interfere with the wheelchair user when the golfing stroke is being played.

The battery and battery recharger unit 24 and seat adjustment mechanism 25 are amongst the heaviest components of the wheelchair. They are positioned in the apertures 22, 23 of the first frame 2 in order to be located close to the ground and thereby provide the wheelchair 1 with a low centre of gravity. Also, the two components 24, 25 are located towards the rear of the wheelchair so that the centre of gravity of the unladen wheelchair is a short distance (such as 10 cm) in front of the centre line running between the centres of the rear wheel units 12, 13. When the wheelchair user sits on the seat 27 and a bag of golf clubs 40 is positioned on top of the battery and battery recharger unit 24, the centre of gravity of the laden wheelchair is approximately halfway between the rear wheel units 12, 13 and the front castor wheel units 10, 11. This provides the wheelchair with good stability.

When the wheelchair user is in the standing position F and plays a golfing stroke, the wide track of the front castor units 10, 11 provides the wheelchair with good lateral stability and prevents the wheelchair from toppling over sideways as the golfing stroke is played.

The weight of the wheelchair is kept as low as possible (e.g. by the use of lightweight batteries) and is distributed over a wide surface area of the ground by the wheel units 10, 11, 12, 13 by virtue of the fact that those wheel units have a comparatively wide width. Thus, owners of a golf course need not fear that their fairways and greens will be damaged by the wheelchair and should be prepared to permit disabled golfers to use the wheelchair on courses hitherto used exclusively by able-bodied players.

Because the standing position F of the user of the wheelchair enables the wheelchair user to be positioned in a manner very similar to the position that an able-bodied player would adopt, the disabled user of the wheelchair may use conventional golf clubs and swing in the normal manner. The control buttons 45 of the arm rest 42 may be used to vary the height of the raised position of the seat 27 above its lowered position in order to permit different wheelchair users to select the most appropriate raised position height for their own particular body length and when using golf clubs of different lengths.

We claim:

1. A wheelchair for aiding a disabled user to play the game of golf comprising a chassis having a fore and aft extending centerline, a pair of rear wheel units rotatably mounted on said chassis on a common axis at locations laterally spaced from the centerline by equal distances, each having a width of at least 8 cm, a pair of front wheel units rotatably mounted on said chassis substantially on a common axis at locations laterally spaced from the centerline by equal distances, said front wheel units having a track which is greater than the track of said rear wheel units, each having a width of at least 8 cm, first prime mover means for driving at least one of the wheel units, a seat mounted on said chassis and movable between a first position for supporting the user in a seated position and a second position above the first position for supporting the user in a standing position and permitting lateral movement of the user without obstruction, and second prime mover means for driving the seat between its two positions.

2. A wheelchair according to claim 1, wherein the width of each wheel unit is at least 10 cm.

3. A wheelchair according to claim 2, wherein the width of each wheel unit is at least 12 cm.

4. A wheelchair according to claim 3, wherein the width of each wheel unit is at least 15 cm.

5. A wheelchair according to claim 4, wherein the width of each wheel unit is at least 20 cm.

6. A wheelchair according to claim 1, wherein each wheel unit has a diameter which is less than 450 mm.

7. A wheelchair according to claim 6, wherein each rear wheel unit has a diameter which is less than 400 mm and wherein each front wheel unit has a diameter which is less than 300 mm.

8. A wheelchair according to claim 1, wherein said seat, at least when in its second position, is located closer to the front wheel units than the rear wheel units.

9. A wheelchair according to claim 1, further comprising at least one arm rest each located at a respective side of the seat, the seat having an upper seat surface arranged to be below the top of the arm rest when the seat is in its first position and level with or above the top of the arm rest when the seat is in its second position.

10. A wheelchair according to claim 9, wherein one of the at least one arm rest includes control means for controlling the first and second prime mover means.

11. A wheelchair according to claim 10, wherein said one arm rest has a forward end and wherein the control means are located in the forward end of said one arm rest.

12. A wheelchair according to claim 10, further comprising storage and display means mounted on one of the at least one arm rest for storing golf balls and for displaying the game score of the user.

13. A wheelchair according to claim 9, further comprising a second frame mounted on the first frame and which supports the back support and the at least one arm rest.

14. A wheelchair according to claim 13, wherein the second frame projects down in front of the front wheel units and there supports at least one foot rest.

15. A wheelchair according to claim 1, further comprising a back support which with the seat, when the seat is in its first position, forms a chair, the back support being separate from the seat, whereby the seat moves up the back support as the seat moves from its first to its second position.

16. A wheelchair according to claim 15, wherein a platform is provided behind the back support and on top of the first prime mover means.

17. A wheelchair according to claim 16, wherein the platform comprises the upper surface of the first prime mover means.

18. A wheelchair according to claim 16 or 17, further comprising pivot means for pivoting an object from a position above the platform to a position closer to the front of the wheelchair.

19. A wheelchair according to claim 16 or 17, further comprising pivot means for pivoting an object from a position above the platform to a position closer to the front of the wheelchair and adjacent to the side of the seat.

20. A wheelchair according to claim 1, further comprising a chassis having a generally planar first frame on which are mounted the front and rear wheel units, said first frame having first and second apertures, the first and second prime mover means being mounted, respectively, in the first and second apertures of the first frame, with the first prime mover means being located between the rear wheel units and arranged to provide drive thereto and the second prime mover means being located between the front and rear wheel units and underneath the seat.

21. A wheelchair according to claim 20, wherein the first frame has a forward cross-member and a pair of struts which project forwards from and outwards away from respective ends of the forward cross-member and which carry respective ones of the front wheel units.

22. A wheelchair according to claim 1, wherein the first prime mover means comprises first and second electric motors each drivingly connected to a respective one of the rear wheel units, the second prime mover means comprises a third electric motor, a gear train and a vertically movable seat support member and the first and second prime mover means further comprise a common battery means.

23. A wheelchair according to claim 1, wherein the seat comprises (i) a rear part which remains substantially horizontal as the seat moves between its first and second positions and (ii) a front part which pivots from a substantially horizontal position to a forwardly downwardly inclined position as the seat moves from its first to its second position.

24. A wheelchair according to claim 23, wherein the front seat part is arranged to permit adjustment of its forwardly downwardly inclined position.

25. A wheelchair according to claim 1, wherein the height of the second seat position above the first seat position is adjustable.

26. A wheelchair according to claim 1, wherein the seat is pivotable, at least in part, about a substantially horizontal axis.

* * * * *